United States Patent [19]

Kawakami et al.

[11] 4,402,757

[45] Sep. 6, 1983

[54] METHOD OF VIBRATING COILED WIRES

[75] Inventors: Heijiro Kawakami; Katsumasa Tanaka; Seiichi Kamamoto; Kazuo Sato, all of Hyogo, Japan

[73] Assignee: Kobe Steel, Limited, Kobe, Japan

[21] Appl. No.: 319,901

[22] Filed: Nov. 10, 1981

Related U.S. Application Data

[63] Continuation of Ser. No. 142,479, Apr. 21, 1980, abandoned.

[30] Foreign Application Priority Data

Feb. 18, 1980 [JP] Japan ..... 55-19344

[51] Int. Cl.[3] ..... B08B 3/12

[52] U.S. Cl. ..... 134/1; 134/14; 134/33

[58] Field of Search ..... 134/1, 14, 17, 33, 184

[56] References Cited

U.S. PATENT DOCUMENTS 3,449,163 6/1969 Möbius et al. ..... 134/1
3,592,690 7/1971 Schoffmann ..... 134/1
3,865,640 2/1975 Möbius et al. ..... 134/1

FOREIGN PATENT DOCUMENTS 2627999 1/1978 Fed. Rep. of Germany ..... 134/1
1926911 2/1979 Fed. Rep. of Germany ..... 134/14

*Primary Examiner*—Richard V. Fisher
*Attorney, Agent, or Firm*—Oblon, Fisher, Spivak, McClelland & Maier

[57] ABSTRACT

This invention discloses a method of vibrating coiled wires in a circumferential motion in a solution bath. The method comprises the steps of suspending a set of coiled wires from a hook whose supporting portion extends parallel to a beam and which is secured to the underside of the beam supported on shock absorbing members, vibrating the beam and the hook by at least one rotary vibrator whose rotating shaft is placed on and parallel to the beam and whose direction of vibration varies continually and cyclically in the plane perpendicular to the beam, and transmitting the vibration of the rotary vibrator to the coiled wires through the hook so that the coiled wires suspended from the hook are rotated along the circumferential direction in the solution bath.

7 Claims, 9 Drawing Figures

METHOD OF VIBRATING COILED WIRE

This is a continuation of application Ser. No. 142,479, filed Apr. 21, 1980, now abandoned.

BACKGROUND OF THE INVENTION

1. Field of the Invention

This invention relates to a method of vibrating a hook suspending coiled wires for the purpose of rotating the wires along the circumferential direction in a treatment bath (containing for example a pickling solution) and of uniformly treating the coiled wires with the solution. More particularly it relates to an improved method of vibrating the suspension hook to obtain a smooth circular motion of the coiled wires.

2. Description of the Prior Art

Hot-rolled wires or those wires that underwent heat treatment have developed scales on their surfaces. These scales must be removed by the proper means, either mechanically or chemically. There are two types of methods of removing scales chemically, i.e., the strand type and the batch type. The strand type of method is to pass a single line of wire through the pickling solution and the batch type is to dip a bunch of coiled wires into the acid solution. These methods must carefully be selected according to the usage of the wires, the condition of the plant site and the condition of the wire materials delivered to the factory. At present time, the batch type of pickling method is widely used.

The batch type of pickling method is used to immerse the coiled wires suspended from the hook into the pickling solution and thereby dissolve iron oxides from the surface of the wires. It is a general practice to provide a vibrator to the suspension hook to vibrate the coiled wires in the pickling solution so that the solution can get into narrow gaps between the wires. FIG. 1 illustrates a typical example of the device for cleaning off scales from the wires. The coiled wires 1 are suspended from a C-hook 3 secured to the underside of a beam 2. The beam 2 is carried by a travelling crane and a hoist crane to a predetermined position where it is lowered. Secured to the upper surface of the beam 2 is a vibrator 4 which may be of an eccentric crank type or an unbalanced weight type directly coupled with an electric motor. In this Figure, the coiled wires 1 are shown immersed in the acid bath 5 containing a pickling solution 6. The beam 2 is mounted on supporting frames 7 erected on each side of the bath 5 with shock absorbers 8 interposed between the beam and the supporting frames. A bunch of coiled wires 1 is moved up and down only, as indicated by the arrow A' in FIG. 2, by the vibrator 4 to expand or narrow the gaps between the wires so as to perform uniform treatment with the pickling solution. In this conventional method, the coiled wires 1 suspended from the hook 3 do not rotate but remain in the same position while in vertical motion so that the upper portion of the wires on the hook are forced together by the weight of the wires while the lower portions separate from each other preventing uniform treatment of wires. To solve this problem, the present inventors have formerly invented a method of vibrating and rotating the suspended coil wires in the solution bath. This method makes use of a vertical vibration as shown in FIG. 2, and is characterized in that the axis of vibration is deviated from or intersects against the vertical line passing through the wire supporting point, or to shift the wire supporting point by means of another contacting member. That is, the conventional method of vibrating the wires consists mainly of vibrating the beam 2 in the vertical direction or in the direction of the Y-axis of FIG. 4—which shows a schematic view of the vibrating device—and shifting the support point of the wires 1 by temporarily lifting the wires from the suspension hook. However, the deviation of the supporting point which can be shifted by this method is very small. The applicant of this invention has found that circular vibration of the beam 2 results in rotating motion of the wires and this new method does not require any special device for rotating the coiled wires.

SUMMARY OF THE INVENTION

As is evident from the foregoing, this invention has as its object the overcoming of the problems which accompanied the conventional method of vibrating the coiled wires. A further object of this invention is to provide a method of vibrating the coiled wires and rotating the same smoothly along the circumferential direction to enable uniform treatment of the coiled wires in the solution bath.

A first embodiment of this invention is a method of vibrating coiled wires. The method includes the steps of suspending a bunch of coiled wires from a hook whose supporting portion extends parallel to a beam and which is secured to the underside of the beam supported on shock absorbing members, vibrating the beam and the hook by at least one rotary vibrator whose rotating shaft is placed on and parallel to the beam and whose direction of vibration varies continually and cyclically in the plane perpendicular to the beam, and transmitting the vibration of the rotary vibrator to the coiled wires through the hook so that the coiled wires suspended from the hook are vibrated and rotated along the circumferential direction in the solution bath.

A second embodiment of this invention is a method of vibrating coiled wires as in the first embodiment, wherein the rotary vibrators on the beam are placed on or arranged symmetrical with respect to a vertical line passing through the center of gravity of a vibrating device which consists of the hook, the beam and the rotary vibrators.

A third embodiment of this invention is a method of vibrating coiled wires as embodied in the first embodiment, wherein when a plurality of rotary vibrators are mounted on the beam in the axial direction. All the rotary vibrators are synchronized so that they vibrate at the same frequency.

A fourth embodiment of this invention is a method of vibrating coiled wires as embodied in the third embodiment, wherein all the rotary vibrators are made to vibrate in the same direction.

A fifth embodiment of this invention is a method of vibrating coiled wires as embodied in the first embodiment, wherein the frequency of the rotary vibrator is made to resonate with the natural frequency of bending of the suspended coiled wires.

A sixth embodiment of this invention is a method of vibrating coiled wires as embodied in the first embodiment, wherein the frequency of the rotary vibrator(s) is varied continually and cyclically so that the rotary vibrator(s) vibrate at the natural frequency of bending of the suspended coiled wires for a certain period of time.

A seventh embodiment of this invention is a method of vibrating coiled wires as embodied in the first embodiment, wherein said beam is supported by a spring at each end.

An eighth embodiment of this invention is a method of vibrating coiled wires as embodied in the first embodiment, wherein the rotating shaft of the rotary vibrator lies in a plane parallel to but shifted from the vertical plane containing the hook and the beam.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

This invention relates to a method of vibrating and rotating the coiled wires suspended from a hook in a circular motion in a plane perpendicular to the axis of a beam by a rotary vibrator or vibrators (a single rotary vibrator 9 consists of a pair of unbalanced weights 11, an electric motor 12 and a rotating shaft 13) which is mounted on the beam with its rotating shaft set parallel to the longitudinal direction of the beam.

The present invention will now be described in detail with reference to the accompanying drawings. It should be noted here that this invention is not limited only to the embodiments shown in the accompanying drawings but can be achieved with different or modified components on the basis of the contents stated in this specification.

Figure 1:
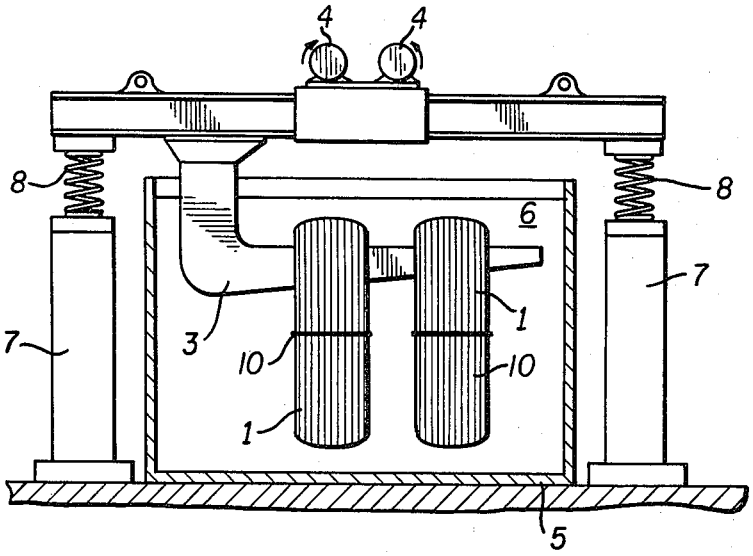
FIG. 1 PRIOR ART
FIG. 1 is a schematic view of a conventional vibrating device for pickling coiled wires in the acid bath.
Figure 2:
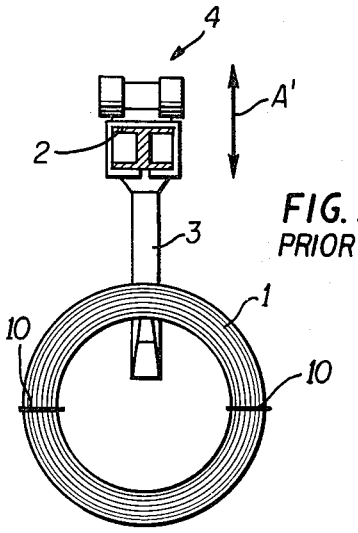
FIG. 2 PRIOR ART
FIG. 2 is a simplified view of the vibrating device and coiled wires as illustrated in FIG. 1, showing the mechanism of vibration.
Figure 3:
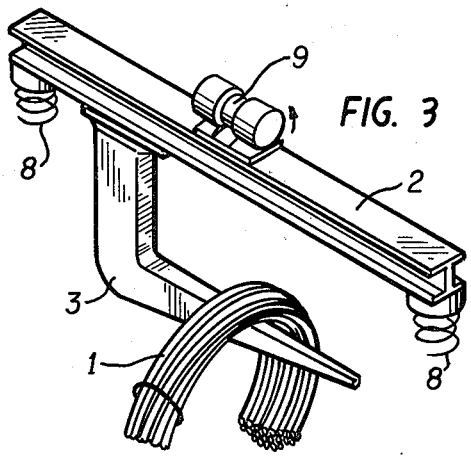
FIG. 3 is a perspective view of the main portion of a vibrating device of this invention.
Figure 9:
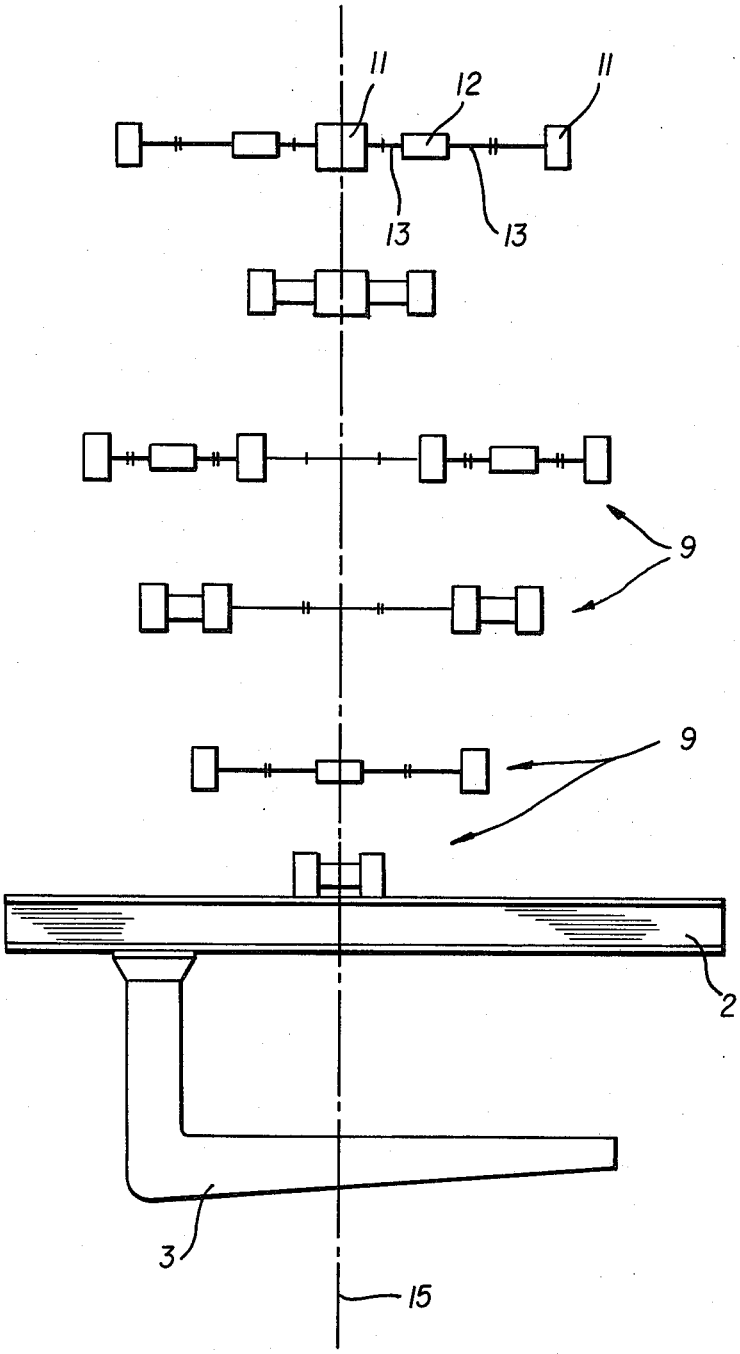
FIG. 9 is an explanatory view showing the position of the rotary vibrators.

FIG. 3 shows an embodiment of this invention, in which a rotary vibrator 9 is rigidly mounted on the top surface of the beam 2 in such a manner that the rotating shaft of the rotary vibrator is set along the longitudinal direction of the beam 2. As shown in FIG. 9, the rotary vibrator on the beam is placed on or arranged symmetrical with respect to the vertical line 15 passing through the center of gravity of a vibrating device which consists of the hook 3, beam 2 and rotary vibrator 9. In this way, various types of rotary vibrators can be used with this vibrating device. The rotating shaft of the rotary vibrator 9 may be shifted in the direction of the width of the beam 2 while maintaining the parallel relationship with the shaft and the beam. A coiled spring is shown as a shock absorber 8 supporting the underside of each of the beam 2. Other types of springs may be used to hold the beam 2 therebetween, if desired.

Figure 4:
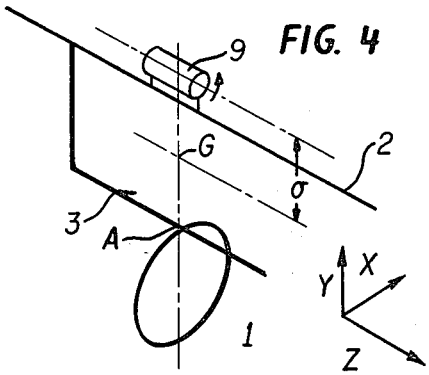
FIG. 4 is a schematic view showing the construction of the vibrating device of this invention.
Figure 5:
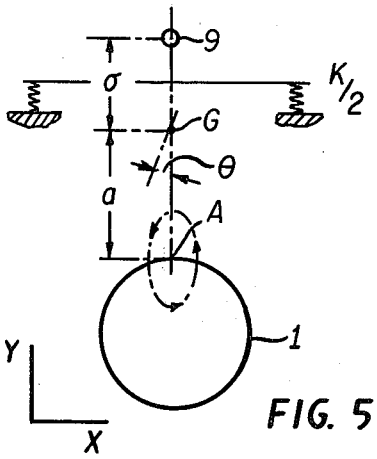
FIG. 5 is a schematic view showing the action of the vibrating device and the motion of the coiled wires.

The method of vibrating the coiled wires by the device with the above-mentioned construction can best be explained introducing the three-axis coordinates as schematically illustrated in FIG. 4. The Y-axis is represented by a line of intersection between a plane crossing a supporting point A of the hook and perpendicular to the axis of the beam and a plane containing the axes of the hook and the beam, the Z-axis by a line parallel to the axis of the beam and the X-axis by a line perpendicular to both the Y- and Z-axis. The center of gravity G of the supporting system comprised of the beam 2, the suspension hook 3 and the coiled wires 1 is located below the rotary vibrator 9 by a distance of $\sigma$. If the rigidity of the suspension hook is sufficiently large, the vertical force (along the Y-axis) generated by the vibrator 9 is imparted entirely to the coiled wires 1, resulting in a vertical movement of the wires 1. Then, the horizontal force (along the X-axis) of the vibrator will result in a moment about a line passing through the point G parallel to the Z-axis, causing the coiled wires supporting point A on the hook to move in the direction of the X-axis. The vibrator 9 is continuously changing the direction of vibration from the Y-axis to the X-axis and from the X-axis to the Y-axis. The supporting point A then moves corresponding to the motion of the vibrator as shown in FIG. 5 so that the bunch of suspended coiled wires 1 also performs rotary motion.

This motion is described in more detail in the following. FIG. 5 shows the rotating shaft of the vibrator 9 as extending toward the reader, i.e., perpendicular to the plane of the paper (or parallel to the Z-axis), and located above the center of gravity G (the center of rotation) by a distance of $\sigma$. If we let the frequency of the vibrator be $\omega_f$ and the amplitude of vibrating force be F, the vibrating force in the direction of the Y- and X-axes, Fy and Fx, can be expressed as:

$$Fy = F \sin(\omega_f \cdot t) \tag{1-1}$$

$$Fx = F \sin\left(\omega_f \cdot t - \frac{\pi}{2}\right). \tag{1-2}$$

Considering the balance of forces in the direction of the Y-axis, we obtain the following equation of motion.

$$(m+Mv)\ddot{Y}+KY=Fy \tag{2}$$

where Mv is an equivalent mass of the coiled wires that contributes to the motion of the system along the Y-axis; m is a mass of this system other than the coiled wires; and K is a spring constant. Putting the equation (1-1) in the equation (2) and solving for Y, we obtain:

$$Y = \frac{F}{-(m + Mv)\omega_f^2 + K} \sin(\omega_f \cdot t). \tag{3}$$

As for the motion in the direction of X-axis, the following equation of motion of the point G holds.

$$(m+M_H)\ddot{X}_G=Fx \tag{4}$$

where $X_G$ is a displacement of the point G; and $M_H$ is an equivalent mass of the coiled wires that contributes to the motion of the system along the X-axis. Putting the equation (1-2) in the equation (4) and resolving for $X_G$, we obtain $$X_G = -\frac{F}{(m + M_H)\omega_f^2} \sin\left(\omega_f \cdot t - \frac{\pi}{2}\right). \quad (5)$$

The motion in the direction of X-axis of the point A where the hook and the coiled wires contact each other depends not only on the motion of the point G represented by the equation (5) but also on the moment generated by the vibrating force $F_X$ applied at a distance of $\sigma$ from the point G. Considering the equilibrium of moments about the point G, we obtain $$I\ddot{\theta} + Kl^2\theta = -F_X \cdot \sigma \quad (6)$$

where l is the distance between G and the springs and I is a moment of inertia of the system about the point G. If we let the distance from the point G to the point A be a, the displacement XM of the point A in the direction of X-axis as caused by the moment is expressed as $XM = a \cdot \theta$. Hence the equation (6) can be rewritten as $$\frac{I}{a}\ddot{X}M + \frac{Kl^2}{a} XM = -FX \cdot \sigma. \quad (7)$$

Putting the equation (1-2) in the equation (7) and resolving for XM, we obtain $$XM = \frac{F \cdot \sigma}{\frac{I}{a}\omega_f^2 - \frac{Kl^2}{a}} \sin\left(\omega_f \cdot t - \frac{\pi}{2}\right). \quad (8)$$

Since the displacement of the point A in the direction of X-axis is X=XG+XM, $$X = \left\{ -\frac{F}{(m + MH)\omega_f^2} + \frac{F \cdot \sigma}{\frac{I}{a}\omega_f^2 - \frac{Kl^2}{a}} \right\} \sin\left(\omega_f \cdot t - \frac{\pi}{2}\right). \quad (9)$$

Thus, the motion of the point A can be expressed as follows by combining the equations (3) and (9) using t as a parameter:

$$\left\{ \frac{X}{-\frac{F}{(m + MH)\omega_f^2} + \frac{F \cdot \sigma}{\frac{I}{a}\omega_f^2 - \frac{Kl^2}{a}}} \right\}^2 + \left\{ \frac{Y}{\frac{F}{-(m + Mv)\omega_f^2 + K}} \right\}^2 = 1. \quad (10)$$

The equation (10) represents the locus of (an) ellipse, thus evidencing that the point A moves in an elliptical path.

In this way, the suspension point A can be vibrated into an elliptical motion, which in turn causes the wire coils to rotate along their circumferential direction.

To effectively vibrate the coiled wires into rotary motion, it is desirable to resonate the frequency of the rotary (elliptical) motion of the point A with the natural frequency of bending of the coiled wires. The frequency of the point A is equal to the frequency of the rotary vibrator $\omega_f$. If we let the natural frequency of bending of the coiled wires be $q_c$, the two frequencies resonate when $\omega_f = q_c$. Thus, the coiled wires can most effectively be vibrated into rotary motion by setting the frequency $\omega_f$ of the rotary vibrator equal to the natural frequency of bending $q_c$ of the wires.

However, since the natural frequency of bending $q_c$ of the coiled wires 1 depends on the wire diameter, it is necessary to vary the frequency $\omega_f$ of the rotary vibrator until it becomes equal to the natural frequency $q_c$ so as to effectively vibrate the coiled wires in the solution bath. The natural frequency of bending for each coil of wire can be determined by the following equation which contains various factors. From the flexural vibration theory for rings, the natural frequency $q_c$ of coiled wire is expressed as a natural frequency of a ring in an in-plane flexural vibration. Namely, $$q_c = \frac{1}{2\pi}\sqrt{\frac{Eg}{\gamma} \cdot \frac{16I}{AD^4} \cdot \frac{i^2(1 - i^2)^2}{1 + i^2}} \quad (11)$$

where i is an i-th natural vibration mode, D a ring diameter, A a wire cross-sectional area, I a geometrical moment of inertia, E a Young's modulus, $\gamma$ a specific weight, and a gravitational acceleration. If we let the wire diameter be a, then A and I can be expressed as $$A - \frac{\pi a^2}{4} \qquad I = \frac{\pi a^4}{64}. \quad (12)$$

Then the equation (11) can be written as $$q_c = \frac{1}{2\pi}\sqrt{\frac{Eg}{\gamma} \cdot \frac{a^2}{D^4} \cdot \frac{i^2(1 - i^2)^2}{1 + i^2}}. \quad (13)$$

The natural frequencies for the coiled wires with the wire diameter a of 5.5–28 mm and the ring diameter D of 700–1400 mm and with the fundamental mode of i=2 are shown in the table below, for reference. In determining the natural frequency, $E = 2.1 \times 10^6$ kg/cm$^2$, $\gamma = 7.8 \times 10^{-3}$ kg/cm$^3$ and g=980 cm/sec$^2$ were used.

| | Natural Frequency of Coiled Wires (Hz) | | | | | | | |
|---|---|---|---|---|---|---|---|---|
| | a(mm$^\phi$) | | | | | | | |
| D(mm$^\phi$) | 5.5 | 6.5 | 7.0 | 8.0 | 9.5 | 12.0 | 13.0 | 28.0 |
| 700 | 24.6 | 29.1 | 31.3 | 35.8 | 42.5 | 53.7 | 58.2 | 125.3 |
| 800 | 18.9 | 22.3 | 24.0 | 27.4 | 32.6 | 41.1 | 44.6 | 96.0 |
| 950 | 13.4 | 15.8 | 17.0 | 19.4 | 23.1 | 29.2 | 31.6 | 68.1 |
| 1000 | 12.1 | 14.3 | 15.4 | 17.5 | 20.8 | 26.3 | 28.5 | 61.4 |
| 1050 | 10.9 | 12.9 | 13.9 | 15.9 | 18.9 | 23.9 | 25.9 | 55.7 |
| 1100 | 10.0 | 11.8 | 12.7 | 14.5 | 17.2 | 21.8 | 23.6 | 50.8 |
| 1150 | 9.1 | 10.8 | 11.6 | 13.3 | 15.8 | 19.9 | 21.6 | 46.4 |
| 1200 | 8.4 | 9.9 | 10.7 | 12.2 | 14.5 | 18.3 | 19.8 | 42.7 |
| 1350 | 6.6 | 7.8 | 8.4 | 9.6 | 11.4 | 14.4 | 15.6 | 33.7 |
| 1400 | 6.2 | 7.3 | 7.8 | 9.0 | 10.6 | 13.4 | 14.5 | 31.3 |

Referring to the above table, it is possible to estimate the natural frequency of each set of coiled wires. But to set the frequency of the vibrator equal to the natural frequency of each set of coiled wires, it is necessary to replace or adjust the vibrator or its components. If many sets of coiled wires of different wire diameters are to be treated in the solution bath, much time will be lost in adjusting the vibrator. Thus, it is desired that vibrations for different wire diameters be generated by a single vibrator. The natural frequencies of the coiled wires shown in the preceding table are only an approximate estimation, and strictly speaking, each bunch of coiled wires has a certain range in its natural frequency because each coiled wire coil has a certain range in the wire diameter as well as ring diameter. This fact is utilized in this invention, in which the frequency of the vibrator is cyclically varied within a predetermined range to rotate various coiled wires with different wire and ring diameters and with different natural frequencies reliably and stably.

Figure 8:
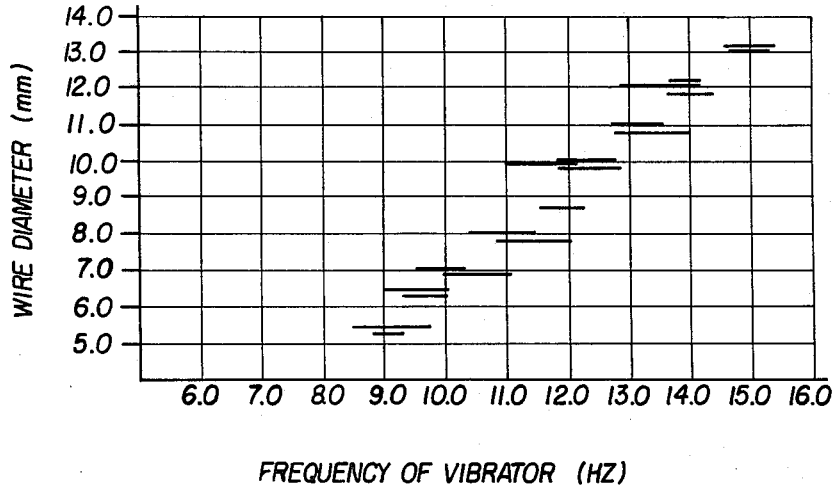
FIG. 8 is a graph showing the relation between the frequency of the vibrator and the wire diameter.

Experiments have been carried out with various sets of coiled wires with the range of 5.5–15.0 mm in wire diameter, 900–1200 mm in the average coil diameter and 1500–2000 kg in coil weight, to determine the frequency of the rotary vibrator (or the natural frequency range of the coiled wires) at which each set of coiled wires is smoothly rotated. The results of the experiments are shown in FIG. 8.

Figure 6:
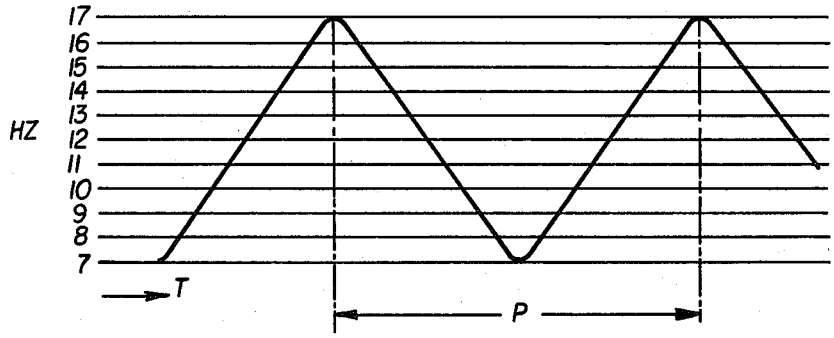
FIG. 6 is a diagram showing the variation of frequency of the vibrator.
Figure 7:
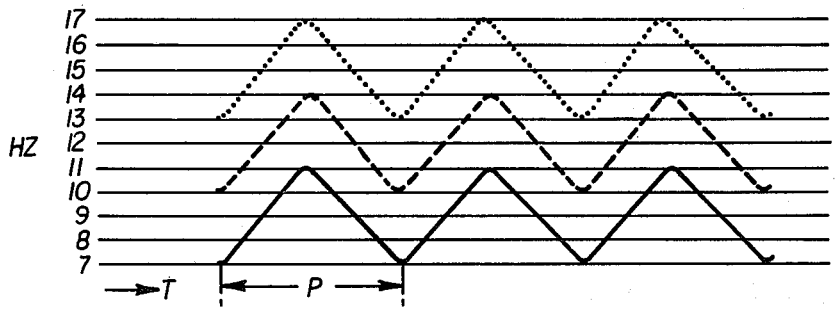
FIG. 7 is a diagram showing another example of the frequency variation of the vibrator.

It is found from these results that the range of frequency for effectively rotating all the sets of coiled wires with the wire diameters of 5.5–15.00 mm is 7–17 Hz. If the frequency of the vibrator is varied within this range in a predetermined cycle, each set of coiled wires meets its natural frequency twice each cycle so that the effective rotation of the wires can be obtained. A frequency converter can be connected to the power supply for the rotary vibrator to vary the frequency of the vibrator within a predetermined range in a given time cycle. FIG. 6 is a diagram showing the variation of the frequency of the vibrator in which the frequency range 7–17 Hz effective for rotating the wires with wire diameters of 5.5–15.0 mm is taken as the amplitude of variation, and the frequency is varied in a given cycle P, which is an arbitrarily selected time interval. With this method, even if accurate natural frequencies are not known for sets of coils to be treated with the solution, they can be vibrated at their natural frequencies twice every cycle of frequency variation through 7–17 Hz as long as the wire diameters are within the range of 5.5–15.0 mm. If the wire diameters of different sets of coiled wires fall within a limited range, the frequency of the vibrator may be varied within 7–11 Hz as shown by the solid line in FIG. 7. The dashed line represents the variation of frequency of the vibrator within the range of 10–14 Hz, and the dotted line, of 13–17 Hz. Selection of the frequency can be made by switching over the frequency converter or by using other devices. Application of vibrations in limited frequency ranges reduces adverse effects on the structure since unnecessary vibration is not imparted.

When a plurality of rotary vibrators are used, the cost of the vibrating device can be kept to a minimum by controlling these vibrators by a single frequency converter. In this case, the direction of vibration is the same for all the rotary vibrators.

As can be seen in the foregoing, in this invention the hook whose supporting portion extends parallel to the axis of the beam is given rotary vibrations by the rotary vibrator(s) on the beam whose rotating shaft is set parallel to the axis of the beam and which is placed on or arranged symmetrical with respect to the vertical line passing through the center of gravity of the vibrating device which consists of the hook, the beam and the rotary vibrator(s); hence the coil of wires suspended from the hook and immersed in the solution bath can be smoothly rotated along its circumferential direction so that the bunch of coiled wires can be uniformly treated with the solution in the bath. Furthermore, since the frequency of the rotary vibrator is continuously and cyclically varied within the range necessary to vibrate the coiled wires into rotary motion, each set of coiled wires can be vibrated at its natural frequency for a certain period of time. In addition, since the resonating vibration causes the coiled wires to vibrate in greater amplitude in the radial direction, a bundling wire 10 even with a large diameter can easily move over the supporting point of the hook so that the batch of coiled wires is smoothly and reliably rotated in the circumferential direction.

While in this embodiment the rotating shaft of the rotary vibrator 9 is shown disposed on the central portion of the beam 2 widthwise and extending along the axis of the beam, the position of the rotating shaft may be shifted widthwise of the beam without changing the axial direction. The rotating shaft may also be set apart from the beam on either side by means of brackets. Shifting the position of the shaft in this way will produce the same effect as when the shaft of the vibrator is set on the central axis of the beam. In other words, the rotating shaft of the vibrator may be set in any plane parallel to the vertical plane containing the hook and the beam.

With this method of vibrating the coiled wires, it is possible to uniformly treat the wires with the solution in the bath, improving the work efficiency and the surface quality of the treated wires. This method has a further advantage that since the coiled wires are not supported at the same points by the suspension hook for a long period of time, the stress corrosion of the wires can be prevented.

The vibrating device for use in this method can be obtained simply by employing the rotary vibratory with its rotating shaft arranged as described previously and by providing the frequency converter, so that this invention can easily be embodied by modifying the conventional facilities with little additional cost.

Obviously, numerous (additional) modifications and variations of the present invention are possible in light of the above teachings. It is therefore to be understood that within the scope of the appended claims, the invention may be practices otherwise than as specifically described herein.

What is claimed as new and desired to be secured by Letters Patent of the United States is:

1. A method of vibrating coiled wires in a circumferential motion in a solution bath, comprising the steps of:

suspending a wire coil from a hook whose supporting portion extends parallel to the length of a beam and which is secured to said beam, said coil having a natural frequency of bending, said beam being supported on resilient members; and vibrating said coil and rotating said coil along the circumferential direction of said coil in said solution bath by:

vibrating said beam and said hook by at least one rotary vibrator whose rotating shaft is placed parallel to the length of said beam and whose direction of vibration varies continually and cyclically in a plane perpendicular to said beam, transmitting the vibration of said rotary vibrator to said coil through said hook so that said coil suspended from said hook is vibrated and rotated, and continually and cyclically varying the frequency of vibration of said beam within a range including said natural frequency of bending.

2. A method of vibrating coiled wires as set forth in claim 1, wherein said at least one rotary vibrator on said beam is arranged symmetrical with respect to a vertical line passing through the center of gravity of a vibrating system which consists of said hook, said beam, and said rotary at least one vibrator.

3. A method of vibrating coiled wires as set forth in claim 1, wherein a plurality of said rotary vibrators are mounted on said beam in the longitudinal direction of said beam, all said rotary vibrators being synchronized so that they vibrate at the same frequency.

4. A method of vibrating coiled wires as set forth in claim 3, wherein all said rotary vibrators are made to vibrate in the same direction.

5. A method of vibrating coiled wires as set forth in claim 1, wherein said resilient members comprise a spring at each end of said beam.

6. A method of vibrating coiled wires as set forth in claim 1, wherein the rotating shafts of said at least one rotary vibrator is disposed in a plane parallel to but shifted from the vertical plane containing said hook and said beam.

7. A method of vibrating coiled wires as set forth in claim 1, wherein said at least one rotary vibrator on said beam is located on a vertical line passing through the center of gravity of a vibrating system which consists of said hook, said beam, and said rotary at least one vibrator.

* * * * *

UNITED STATES PATENT AND TRADEMARK OFFICE

CERTIFICATE OF CORRECTION

PATENT NO. : 4,402,757

DATED : September 6, 1983

INVENTOR(S) : HEIJIRO KAWAKAMI ET AL

It is certified that error appears in the above-identified patent and that said Letters Patent is hereby corrected as shown below:

In column 2, line 63, delete "first" and substitute --fifth--.

In column 4, line 1, after "each" insert --end--.

In column 5, line 50, please delete superscript "2".

In column 6, line 29, after "and" insert --g--.

line 34, please change the formula to read as follows:

$$A = \frac{\pi a^2}{4}$$

In column 8, line 38, delete "vibratory" and substitute --vibrator--.

line 47, delete "practices"and substitute -- practiced --.

Signed and Sealed this

Fourteenth Day of February 1984

[SEAL]

Attest:

GERALD J. MOSSINGHOFF

Attesting Officer

Commissioner of Patents and Trademarks